United States Patent [19]

Ochsner

[11] 4,432,217

[45] Feb. 21, 1984

[54] COLORED YARN PRINTING APPARATUS

[76] Inventor: Arnold Ochsner, 3200 Fort Charles Dr., Naples, Fla. 33940

[21] Appl. No.: 330,683

[22] Filed: Dec. 14, 1981

[51] Int. Cl.[3] ..... D06B 1/14; D06B 11/00

[52] U.S. Cl. ..... 68/5 D; 68/203; 101/172

[58] Field of Search ..... 68/5 D, 5 E, 9, 202, 68/203, 205 R; 28/1, 3, 164, 171, 218, 219; 101/172; 112/79 A, 83, 84, 121.11; 118/224, 234, 696, 697; 242/56.4, 56.5

[56] References Cited

U.S. PATENT DOCUMENTS

| | | | |
|---|---|---|---|
| 3,227,077 | 1/1966 | Farrer et al. | 101/172 |
| 3,788,246 | 1/1974 | Ochsner | 112/83 |
| 3,863,310 | 2/1975 | Ochsner | 28/164 |
| 4,116,626 | 9/1978 | Varner | 8/149 |
| 4,170,883 | 10/1979 | Varner | 68/205 R |

FOREIGN PATENT DOCUMENTS

| | | | |
|---|---|---|---|
| 2059876 | 4/1981 | United Kingdom | 101/172 |

*Primary Examiner*—Philip R. Coe
*Assistant Examiner*—Michael Knick
*Attorney, Agent, or Firm*—William V. Pesce

[57] ABSTRACT

A system for color printing and processing multiple yarn fibers by mechanized means in response to programmed signals derived from a computer control devise indicative of fabrics having select patterns or designs. The system includes data gathering implements including a sample pattern to be duplicated for producing a program for color printing. The computer receives the data and processes it to produce signals indicative of the color program. A control device receives the signals from the computer and initiates control voltages for driving a color printer which color prints yarns passing therethrough in accordance with the program. The colored printed yarns are processed through fixing apparatus to fix the colors and thereafter separated into individual yarn fibers and stored for immediate or future use in looms, weaving machines and the like.

8 Claims, 18 Drawing Figures

COLORED YARN PRINTING APPARATUS

This invention relates to the production of colored yarns and/or fibers for use on looms and or knitting machines, and is particularly directed to yarn printing apparatus and methods for printing color variations indicative of color patterns or configuration under computerized operations and control.

In my previous U.S. Pat. Nos. 3,788,246 and 3,863,310 I disclosed therein apparatus and process for producing multi-colored yarns for use in Schiffli-type embroidery machines consisting of first producing a punched tape programmed according to color variations of a pattern to be embroidered on fabric material. The tape is cut simultaneously with a standard tape of the Jacquard type used on these machines. After the color tape is produced, it is used to control a multi-colored dye system where a continuously moving yarn has the different colored dyes applied thereto in accordance with the colored tape which controls the application of the dye selectively. After the yarn is completely and selectively dyed, it is inserted back onto the machine in proper sequence and synchronized with the original standard tape so that the needle stitching produces a multi-colored embroidery according to the original design.

It is intended by the invention to be described herein to improve on the foregoing inventions by providing a computer-type programmable color printing or dying machine for printing one or more colors on one or both sides of the yarn in any desired lengths, and in any desired color sequence. Further, the program may be changed or modified in any manner before or during the printing process without stopping the apparatus for printing. This was not possible in my previous inventions.

It is therefore a principle object of the invention to provide a computer programmable printing machine for printing one or more colors on one or on both sides of a material in any desired length and in any desired color sequence, the colors being applied in a uniform or non-uniform sequence.

Another object of the invention is to provide a computer programmable printing machine which can be programmed to accommodate any pattern or design to be imposed on any fabric or yarn undergoing stitching, weaving, or knitting by machine, and to totally eliminate set-up time for producing patterns, make short-run production thus increasing efficiency, and lowering costs.

And another object of the invention is to provide a programmable printing machine having a plurality of equally spaced apart color printing stations each indicative of a specific color for printing yarns and each controllable to print colors along the yarn length at selective station or/stations and in selective amounts.

A still further object of the invention is to provide a color printing machine disposed to accommodate programmable yarns in ribbon form for convenience of multiple strands of conveyance and subsequent separation of yarn strands to form a single spool or bobbin of yarn usable on a knitting machine.

A still further object of the invention is to provide a printing machine which applies dye to yarns in a coordinated registered manner to assure thorough dye penetration of the yarn thus assuring maximum bloom to the yarns.

Another object of the invention is to provide storage means for storing data relating to yarn printing machines comprising number of stitches or stitch count, length to stitches, lengths of individual colors, and sequence of colors all pertaining to a particular design or pattern and usable on paper and magnetic tape for controlling the printing machine. Still another object of the invention is to provide a dye printing machine having replaceable sources of color dye adjacent the printer for adjusting color layers, thicknesses and rapid replaceability and convenience.

Additional objects and advantages will become readily apparent from a reading of the specifications and the accompanying drawings and wherein.

SUMMARY OF THE INVENTION

Figure 1:
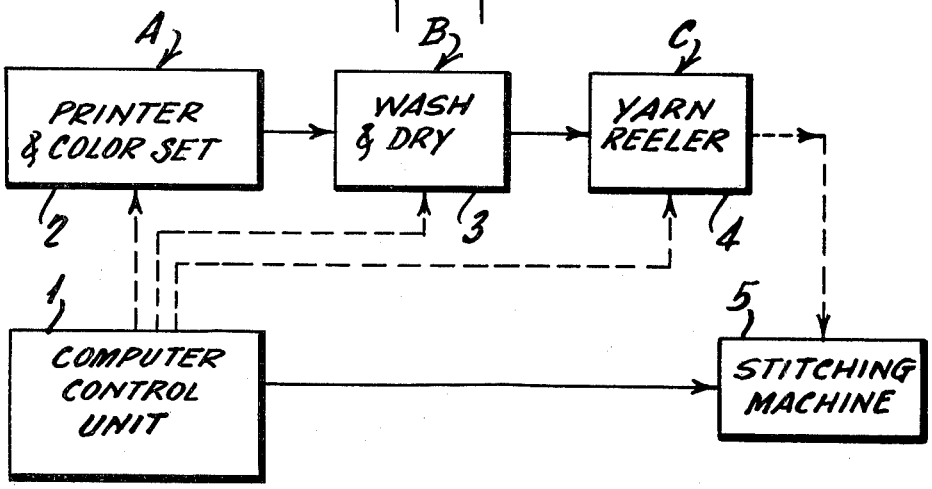
FIG. 1 shows a simple block diagram of the overall system according to the invention herein.

The overall yarn printing system according to the invention is composed of a plurality of separate component parts integrated into an operable system although each component can comprise an entity useful unto itself. The system consists of first producing a specific program indicative of a specific design or pattern having specific color variations, such variations being indicative of numbers of stitches, stitch length, color lengths in each stitching and types of color variations and/or blending to give the specific effects desired. The program as such is then placed into a suitable computer for producing the required inpulse variations necessary to activate a controller mechanism. The controller in response to the computer impulses produces the necessary control voltages which in turn controls the operation of the color printer device.

The color printer device or mechanism is the heart of the overall printing, it is the mechanism that actually prints the various colors in accordance with the desired plan or pattern. The printer comprises a plurality of vertically oriented color printing stations spaced apart a fixed finite distance, each station consisting of a pair of side-by-side abutting rollers disposed to rotate inwardly and opposite to each other, each station having a source of color dye in which one or both rollers may be in contact with for printing. The rollers are constantly driven from a fixed motor-drive source and made to abut and separate under the influence of pressurized air which is in turn under the control of the control voltages emanating from the controller. The printer effects the color printed, the length of the color printed and the color sequence printed all under precise controls.

The color stations as disposed are unique in that the displacement between them is a constant and fixed, and are relevant to the positioning of color as the yarn moves along from station to station. Since the colors from station to station are different, and the printing for a given design may vary over any given design length, the ability to permit printing over a given length during one time period may be different from printing over another time period. However, since the distances between stations are fixed, they must be considered indiginous to the system for the purpose of identifying a particular program. Assume that the color stations are numbered 1 through 6 from top to bottom and the yarn tape is traveling from top to bottom, then colors printed in numerical sequence will require a timing lag; colors printed in reverse numerical order will require a timing lead.

For example: If color #1 is printing and the next color is #2, it will be necessary to stop #1 and wait until the tape travels a distance A (distance between stations) before #2 is actuated. If the next color is #3 instead of #2, then the wait would be 2xA. Conversly if #5 color is followed by #2, then #2 will start printing 3xA distance before #5 stops. This lead and lag timing will be controlled through a program for the computer or from stored data banks to be used with the computer. This idea and others will be better understood from a description of the drawings herein, keeping in mind like parts will have the same reference numbers throughout the respective drawings.

After the printing process has taken place, the tape or yarn is fed through an oven where the color dye, causing the printing, is dried and fixed or developed. The tape is then wound on a reel which is rotated by a torque motor. Actuation of the color recepticles or boxes is as follows:

(1) The roller are caused to rotate by magnetic clutches, (2) After a time delay which allows the rollers to pick up dye from a dye source, the rollers are pressed against the tape by the air cylinder;

(3) When the printing operation is complete, the rollers open up by action of the air cylinder and stop turning. The two sets of feed rollers are operated in the same manner. Instead of color boxes or receptacles, the source of dye may be in the form of a container, placed above the roller and dye emitted therefrom under the control of air pressure. Further means in proximity to the roller may control the thickness of the film along the roller surface, therefore controlling the film thickness of dye along the yarns.

After the tape is printed and dyed, it is moved to the rinse cycle where it is washed and reeled as individual yarns. The wash cycle consists of three tubs, two cold and one hot. To insure that the yarn stays together until it exits, in the drying oven there is a continuous net-tape (transport tape) which passes through the tubs through the ovens, under the oven and tubs, to return to the start. The dyed tape will be clipped to this transport tape at the start of the rinse cycle and will be taken from the tape as it exits the oven. It will be individual yarns at this point and then fed by hand to the yarn reeler.

In the second tub, the hot tub, the cross fiber in the tape will dissolve, and at this point the tape (e.g. will become sixty-four (64) yarns). The transport tape will carry it on through the system until it leaves the transport tape after the oven. The yarns as dyed are suitable for use on stitching, weaving and knitting machines; these yarns are considered the warp yarns as opposed to weft yarns which are singular. However, the weft yarn can be made transverse to the elongated tape, so that the length thereof can be considerable compared to the elongated tape. Here the warp (elongated) yarns are made soluble, so that the transverse weft yarns produced will be very long to provide the desired length of yarn for weaving.

In each of the tubs there is a unique spiral wheel which is disposed to expose as much material as possible in a given amount of time. The rinse cycle is independent of the print cycle, but they are arranged so as to use the same drying oven, hence only one oven being necessary. The spools of the two cycles need not be the same. The yarn reeler will be given by a torque motor. The transport tape in the rinse cycle will be driven by the two rollers at the bottom of the oven and the roller as shown in the drawings.

DETAILED DESCRIPTION OF THE INVENTION

Now describing the invention in more detail relative to the drawings there is shown in FIG. 1 an overall system block diagram which includes a specialized computer and control unit 1 connected to a printer and color set 2 which in turn connects to a wash and dry mechanism 3 and finally terminates in a yarn reeler 4 for use in a stitching machine 5.

FIGS. 2, 5–13, show the actual color printer mechanism and the structured apparatus for actually color printing or dying the yarns under strict control conditions under a specified program stored in the computer. The computer, the programming thereof, and the controls for actuating the printer mechanism is response to the program will be described later after the mechanics of the actual color printer is described.

The printer 2 comprises a structural frame 10 having a pair of spaced apart upright beams 11, 12 each which supports between them a series of color stations 13, each station being composed of a color dye source and apparatus for dye printing yarns in a specific color sequence, in accordance with the program generated for a particular pattern or design configuration.

The color station 13 comprises a pair of abutting oppositely rotatable rollers 15, 16 each supported by shafts 17, 18 each of which is journaled in and supported by support brackets 19, 20 which are in turn carried by a support plate 21 bridged across and supported by upright beams 11 and 12.

Each of the support shafts 17, 18 have connected thereto at one of their extremities a pair of driven spur gears 22, 23 driven by driver gears 24, 25 each of which is connected to shafts 26, 27, said shafts being journaled in and supported by brackets 19 and 20.

Driver gear 25 is driven selectively by a master driver gear 28, the master gear being connected to shaft 29, the said shaft being journaled in and supported by bracket 20, and bracket 30, the said bracket 30 being tied to upright beam 12.

The shaft 29 further carries a clutch mechanism 31 and a helical type gear 32, the said helical gear 32 being driven by a worm gear 33 which is connected to and forms a part of an elongated rotatable shaft member 34, the said shaft member 34 parallels the upright beam 12 and terminates in and is driven by an electrical motor device 35*a*.

The clutch mechanism 31, interposed between the helical gears 32 and master driver gear 28 is for the purposse of disengaging the said helical and master gear to stop the rotation of the rollers 15, 16 under circumstances where manual or selective operation of each of the color stations 13 is desired.

In proximity to and below each of the respective rollers 15, 16 lies a receptacle or color box 35, 36 each carried by the support plate 21, the said color boxes being receptacles for color dye sources. Although the color dye source is shown in the form of color boxes or receptacles, other color sources and the feeding thereof to the rollers are available and will be further described herein at a later time. The rollers are each in their respective movements and rotation disposed to engage and carry dye from the dye sources, in this case the color boxes, and transmit same to the particular yarns or fiber to be printed or dyed in accordance with the particular sequence and length as dictated by the original program design.

The printing rollers 15, 16 each have respectively connected to their outer extremities along their supporting shafts, 17, 18, a linkage system 40, 41 for the purpose of causing the rollers 15, 16 to engage and dis-engage each other depending upon when printing color dye is or is not to take place. The linkage system is comprised of elongated links 42, 43 each end thereof 44, 45 being connected to shafts 17, 18 respectively. Comparable links are also connected at their extremities to the other extremes of shafts 17, 18.

The links 42, 43 each have their other extremities pivotally bolted to a connector 46, the connector in turn being attached to a shaft-like plunger 47 which is in turn tried into and driven by a pressure actuated dual movement or reciprocal action valve 48. The same valve-linkage mechanism resides on the other sides of the respective rollers to cause the movement thereof to be hereinafter described. The valve 48 has an air-pressure source not shown, which enters the valve to cause the activation thereof selectively.

The shafts 17 and 26, and 18 and 27 are each interconnected at the roller extremities and linked by pivotal suspension link supports 50, 51 and 52 and 53 respectively, the support links carrying the rollers in a suspended manner so that the said rollers abut and contact each other along their outer perephery along a line-contact. The suspended rollers have a slight angular freedom of movement, allowed by the pivotal suspension supporting links, but also because of the slightly elongated slots 55, 56, in the brackets 19, 20, in which the shafts 17, 18 are journeled or supported.

The abutting rollers 15, 16 are in normal contact by reason of their suspension and gravitational effect, causing the rollers to normally swing together on their support suspension links. To spread the rollers apart so that there is no pressure contact between them, the valve linkage systems 40, 41 are so designed as to cause the rollers to spread apart under the influence of compressed air selectively applied in a manner to maintain the spread over a time span in accordance with the program selected. Color printing is accomplished while the rollers are in contact, and printing ceases when the rollers are spread apart, although the yarn undergoing printing is continuously moving through the color stations and the machine itself.

The valve linkage mechanism 41 functions in the following manner, the reciprocal valve 48, meaning air can cause the valve to function in a dual fashion, causes the plunger mechanism 47 to move up or down depending on the valve-cock within the valve which deflects the air for either up or down movement. As shown in the respective figures, especially FIG. 13, when the plunger 47 is driven upward, the elongated links 42, 43 are caused to be deflected outward so that the shafts 18, 19 are correspondingly deflected or urged outward, and the rollers 15, 16 carried thereby spread apart. This spread apart, no contact of the rollers, remains in this state so long as the air continues to flow through the valve, and the valve cock maintains its position. The valve is in turn controlled by a special control system to be described later. Reversal of the air-flow causes the plunger to move downward and the rollers are once again in pressure contact with each other.

During the process of causing the spread-apart movement of the rollers, the gearing arrangement controlling the movement of the rollers remains intact, all gears continuing to mesh according to their intended functions. The spur gears 22, 23 are spread apart, but they remain in contact with driver gears 24, 25 and master drive gear 28 also remains with gear 25. All gears continue to function as intended during the spreading action of the rollers, thus continuing the rotation of the respective rollers.

Each of the respective rollers 15, 16 have in proximity thereto color receptacles or boxes 60, 61 respectively for storing or containing color dye 62, 63 which dye adheres to and forms a thin film of color dye on the roller surface as the roller dips into the receptacles selectively. Excess dye or film thickness or the removal thereof is accomplished by the use of blade-like members 64, 65 each hingedly attached to a side of the receptacles by biased hinges 66, 67.

Figure 15:
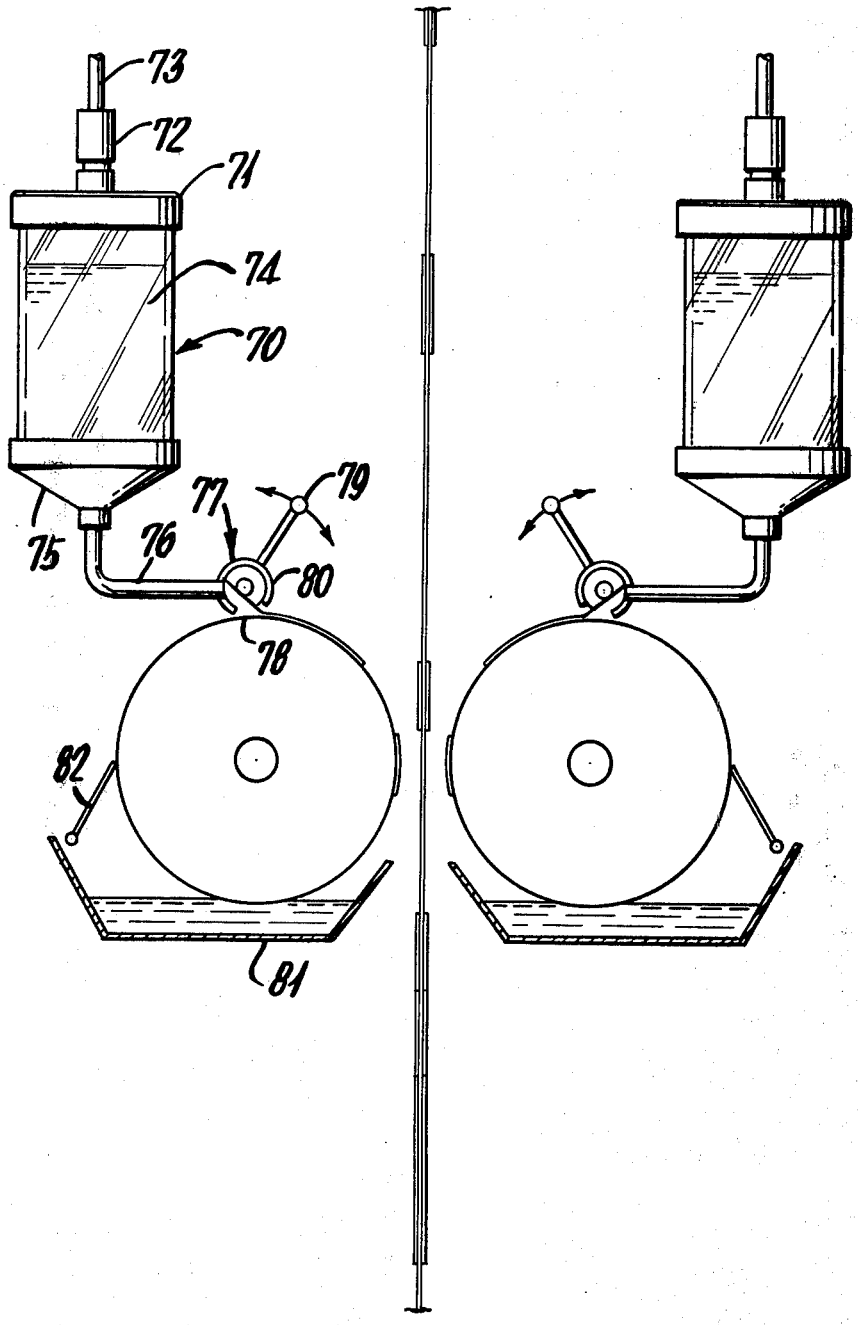
FIG. 15 shows an alternate system for applying dye to the yarn during the printing process.

Another color or dye source configuration is shown in FIG. 15 which provides an injection type dye source also located in proximity to the rollers, and although a dual system is possible and may be preferred in certain arrangements herein, for the purpose of describing this embodiment only a single injection source will be shown and described as per FIG. 15. The injection dye source comprises a transparent container 70 made of plastic, glass or some other material capped by cover 71 having an input 72 connected to an air-supply 73 under pressure, the air-pressure being subjected to or controlled from a pre-arranged and or programmed source of control. The color dye 74 within the container 70 is forced through a funnel-like chamber 75 causing the dye to undergo a restrictive movement through conduit 76, the conduit thereafter terminating into an elongated valve-like mechanism 77 which is designed to permit a film flow of color dye onto the roller of varying thicknesses by the exercise and control of the gap 78 through which the dye must flow. The gap 78 is controlled by a pivotally operated lever 79 having an elongated arm 80 connected thereto which controls the gap size through which the dye must flow.

Beneath the rollers and in proximity thereto lies a receptacle box 81, sitting on support plate 21 of the color station 13, the said receptacle being available for collecting excess dye and scraping from the roller after a dying operation. After each dying operation it is necessary and advisable to remove the residue dye before applying a new and/or different dye. This is simply done by the use of a doctor blade 82 hingedly connected to the receptacle. The residue dye may be conveniently removed by other means such as the use of a vacuum source to remove the dye.

The color dye source container 70 is so disposed as to be conveniently removed from the holding chamber 75, and a new container placed therein and the cap 71 placed thereon. Hence, convenient color dye source is available in a very short period of time.

It is possible to have other methods for printing dye on the yarns, whether the dye is liquid or dried such as in the types used in "Xerox" machines. These dye types may be those available as charged particles, or thermal methods can also be used to color print the yarns.

The color stations 13 as above described does not include stations 90,91 which stations in effect are identical to the color station 13, but there appears at the stations 90, 91 no source of color dye. These stations and the rollers appertaining thereto are for the purpose of starting the yarn flow through the printer since these particular rollers are in constant operation once the machine starts, whereas the color stations are not, but only become operative or functional when a particular color or dye is to be printed upon the yarn as it passes through the rollers.

Figure 2:
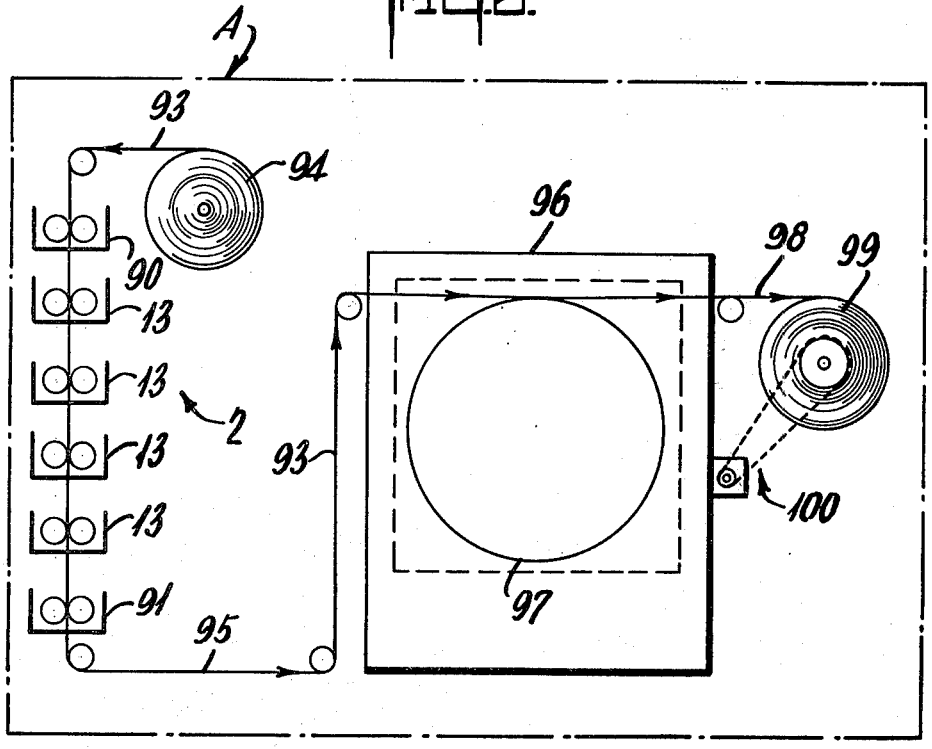
FIG. 2 is a simple diagrammatic plan view of the printing machine and drying oven for the printed yarns and/or fibers.

As shown in FIG. 2, the yarn 93 enters the printer 2, from a reel 94 upon which the multiple yarns are stored in the form of a ribbon arrangement, and the printed yarns 95 exit therefrom to pass into and through an oven 96 into a spiral type wheel 97 specially arranged to accommodate longer lengths of yarns for a fixed oven area, the yarns undergoing a heating process which fixes the color dye thereon. The fixed exiting yarns 98 are then stored on a yarn storage reel 99, the reel being rotated by a motor and pully arrangement 100 for reeling in and storing the exiting fixed colored yarns 98.

Figure 3:
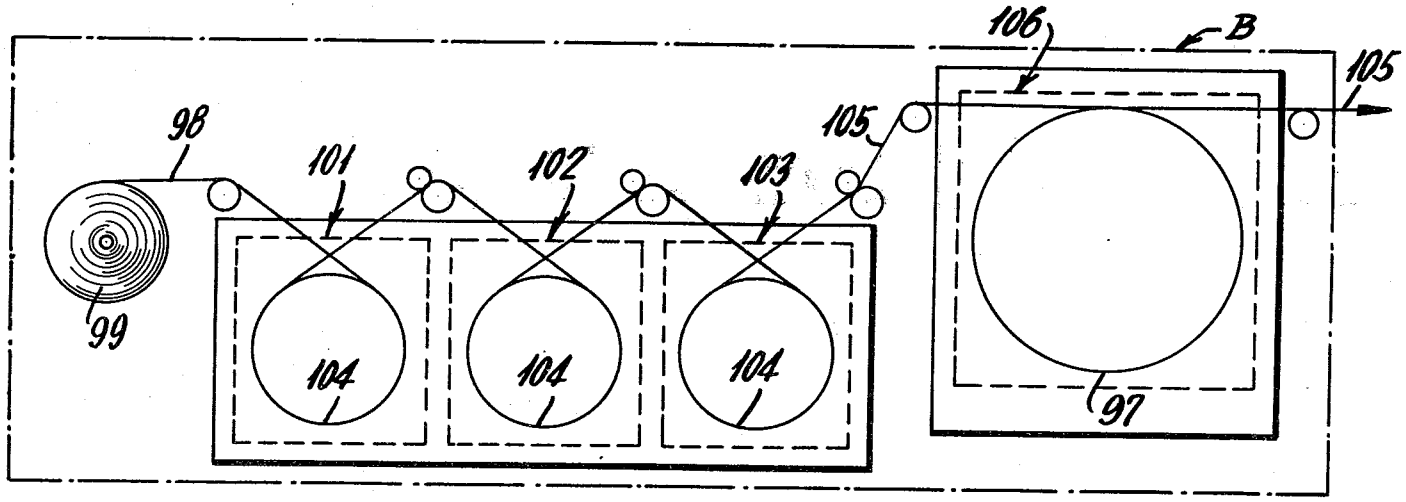
FIG. 3 is a simple diagrammatic plan view of the washing and drying vats for separating the yarns after printing.
Figure 4:
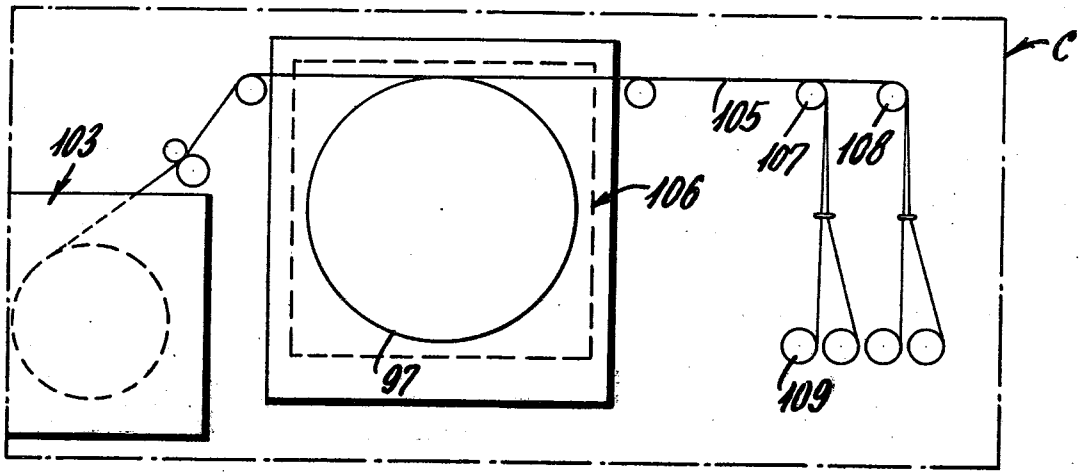
FIG. 4 is a simple diagrammatic plan view of the yarn separation and the placement thereof on spools or reels.
Figure 6:
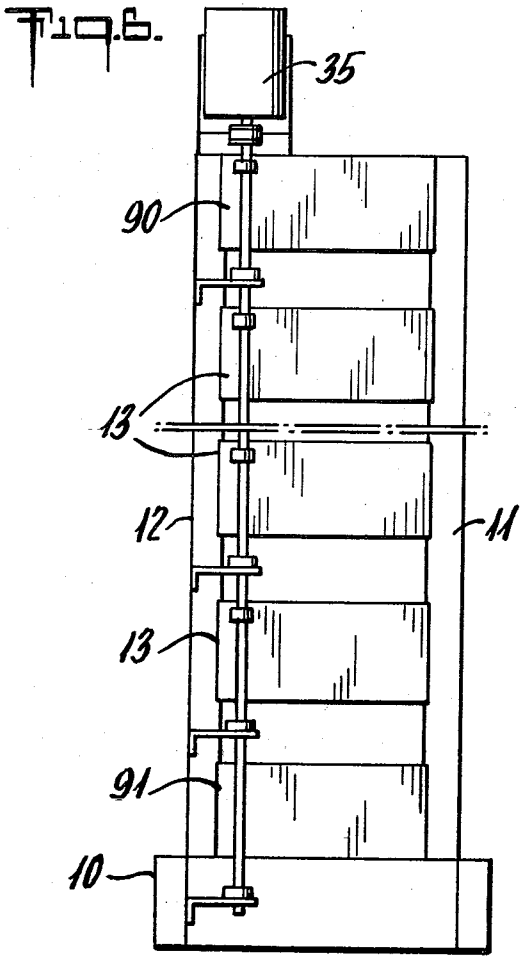
FIG. 6 is a side view of FIG. 5
Figure 5:
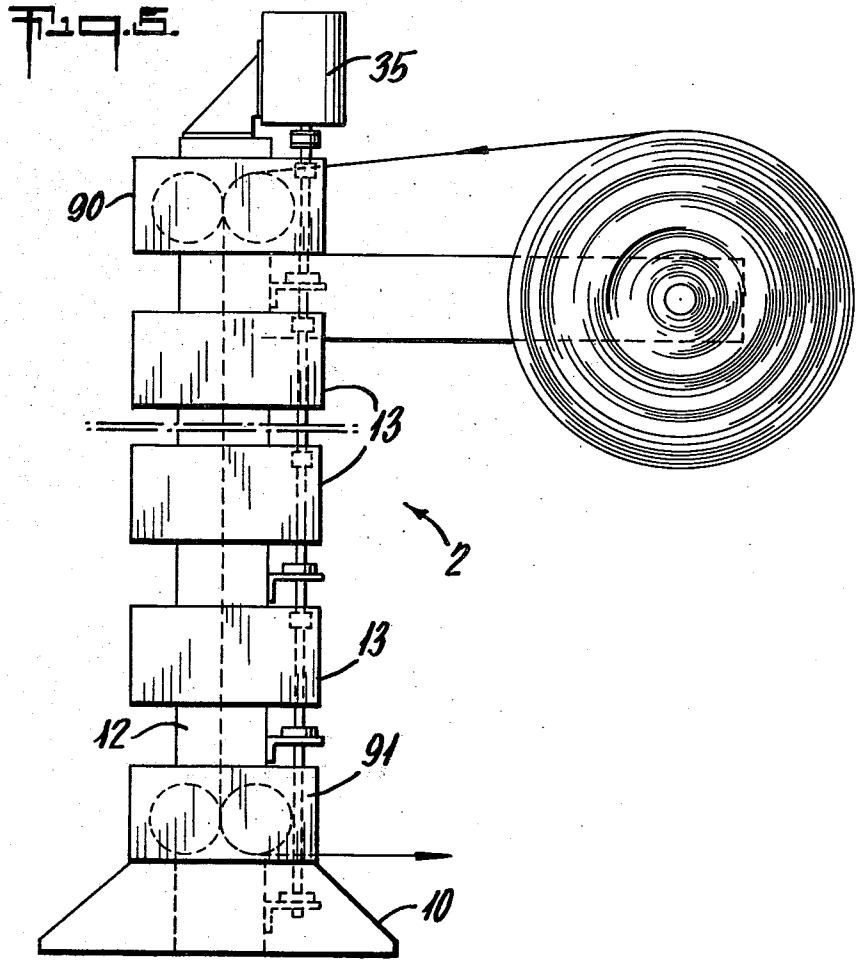
FIG. 5 is a simple diagrammatic plan view of the printing machine with the yarn flowing therethrough.
Figure 7:
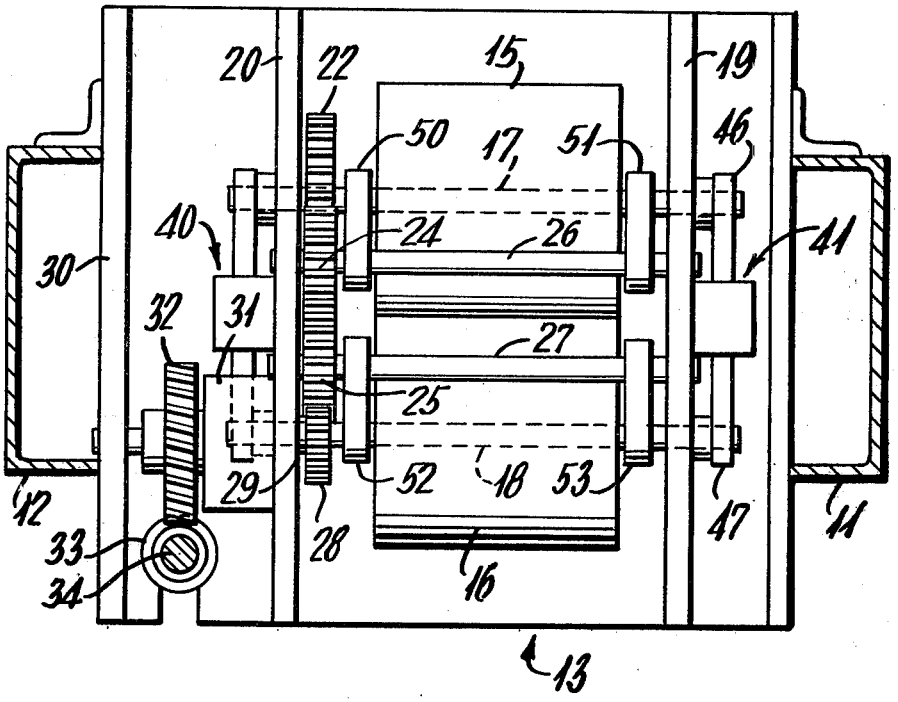
FIG. 7 is a construction elevationed view of a single color station showing the printing rollers in their operable position.
Figure 8:
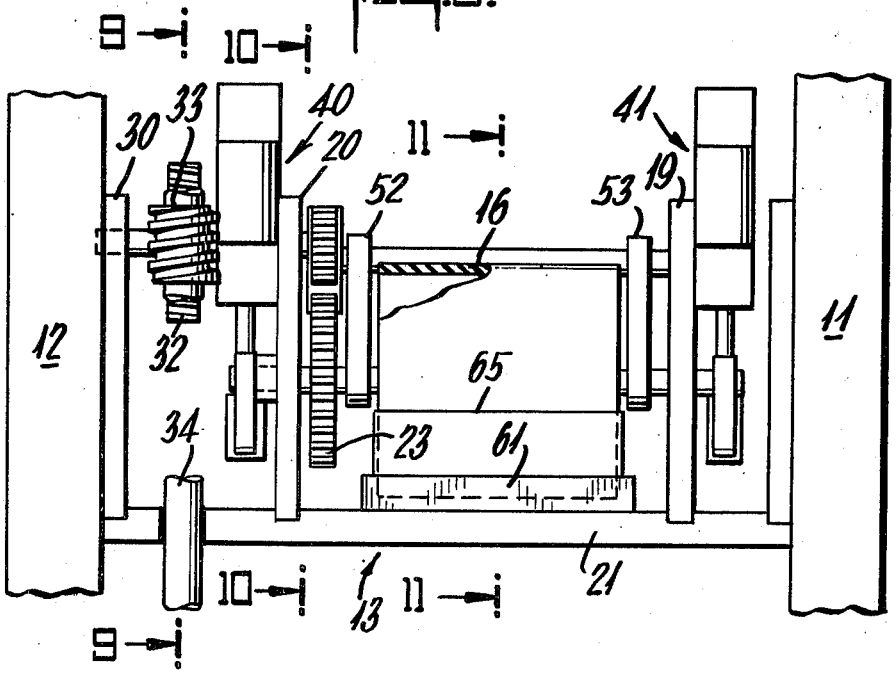
FIG. 8 is a constructional plan view of a single color station of FIG. 7.
Figure 9:
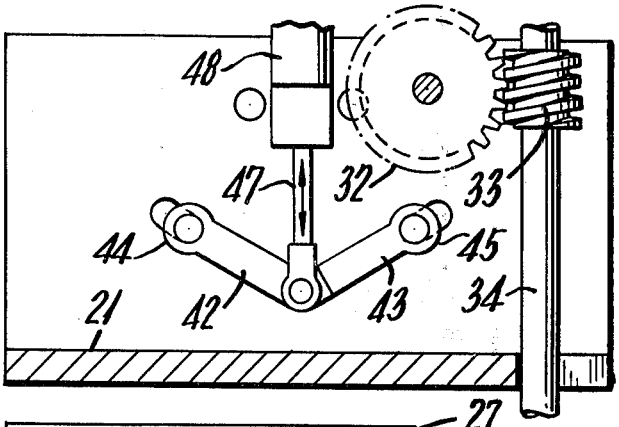
FIG. 9 is a view through the line 9—9 of FIG. 8.
Figure 10:
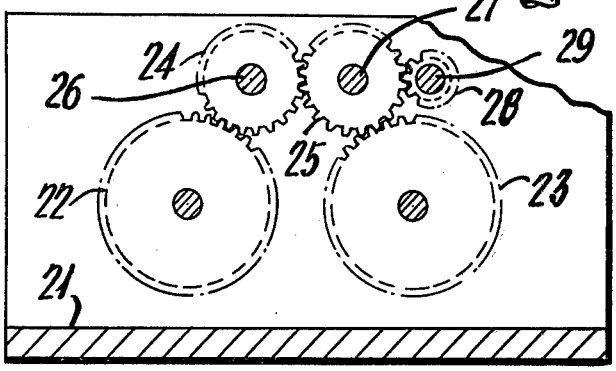
FIG. 10 is a view through the line 10—10 of FIG. 8.
Figure 11:
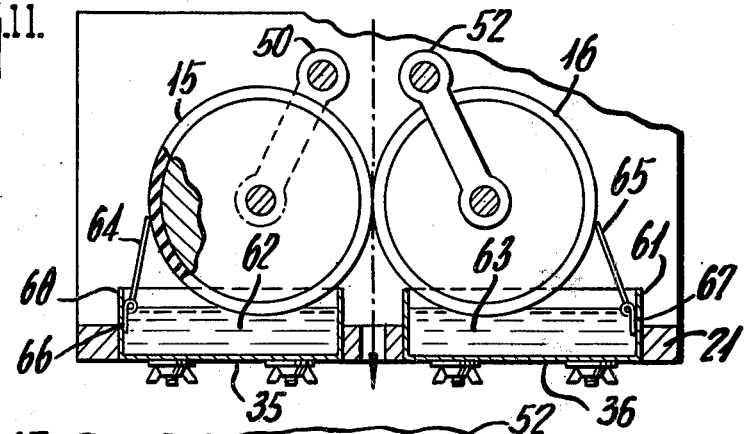
FIG. 11 is a view through the line 11—11 of FIG. 8.
Figure 12:
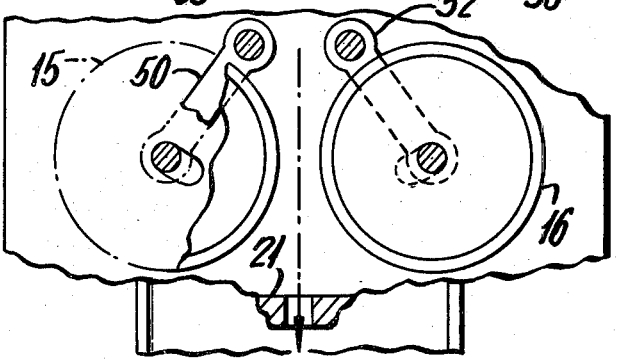
FIG. 12 is similar to FIG. 11 with the rollers separated.
Figure 13:
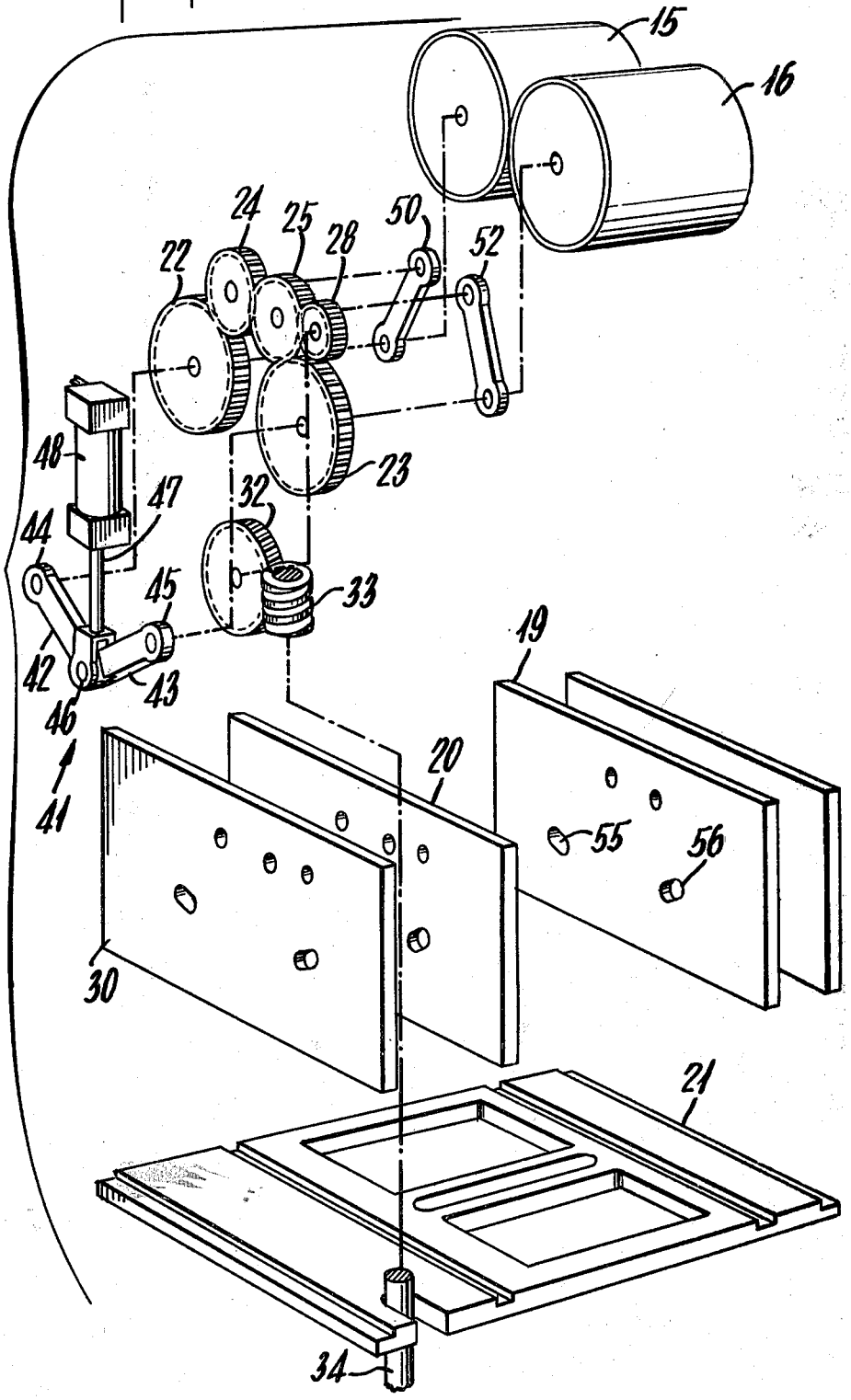
FIG. 13 shows an exploded view of a printing station in perspective.

FIGS. 3 and 4 show the process for preparing and separating the yarns for either storage or for use whatever the case may be. The reel 99 having the fixed printed yarns 98 is then passed through a series of washing vats or tubs for purposes of separating the individual colored yarns from their ribbon form so that the individual yarns may be properly and suitably reeled onto separate reels. It may be mentioned here that a plurality of strands of yarns are placed side-by-side to form a ribbon, the strands held together by cross-soluble fibers. The cross-fibers are actually weaved into the yarn strands to form a ribbon-like material composed of multiple yarn strands. Printing in this fashion permits a large number of strands to be printed at one time. It may also be convenient at this time to have the aid of a net-type transport tape to carry the ribbon-like yarns during the washing and drying process to assure that the individual yarn strands do not separate before it is time to do so. Hence the transport tape will follow the same path that the ribbon takes.

In FIG. 3 the tape is passed through the first washing tub 101 containing cold water to remove and excess dye material. The tape is then passed on through the second wash tub 102 which contains warm or hot water to cause the cross-fibers in the tape to dissolve so that the yarns are individually contained, and finally the tape passes through the final wash tub 103 containing cold water which removes the residue of the soluble cross-fibers. In each of the tubs, the tape passes over and is transported by a unique type spiral wheel 104 so as to be able to transport and carry as much tape during the washing and drying process. Finally the tape 105 containing the individual yarn strands exiting from the washing tubs passes through a final dying process within oven 106; this oven may also be the same oven 96 previously mentioned with respect to FIG. 2, or can be a separate one. The yarn strands 105 are then conveniently separated by separator means 107,108 so that the individual strands are reeled in by separate reels 109 and stored thereon.

To color print the yarns, the color printing machine must be commanded in a fashion to print the yarns according to a pre-arranged design, and to accomplish this design, a special program must be prepared to function within a specialized computer which in turn will operate special control devices which manipulate the printing machine to create the desired color effect on the yarns.

Figure 16:
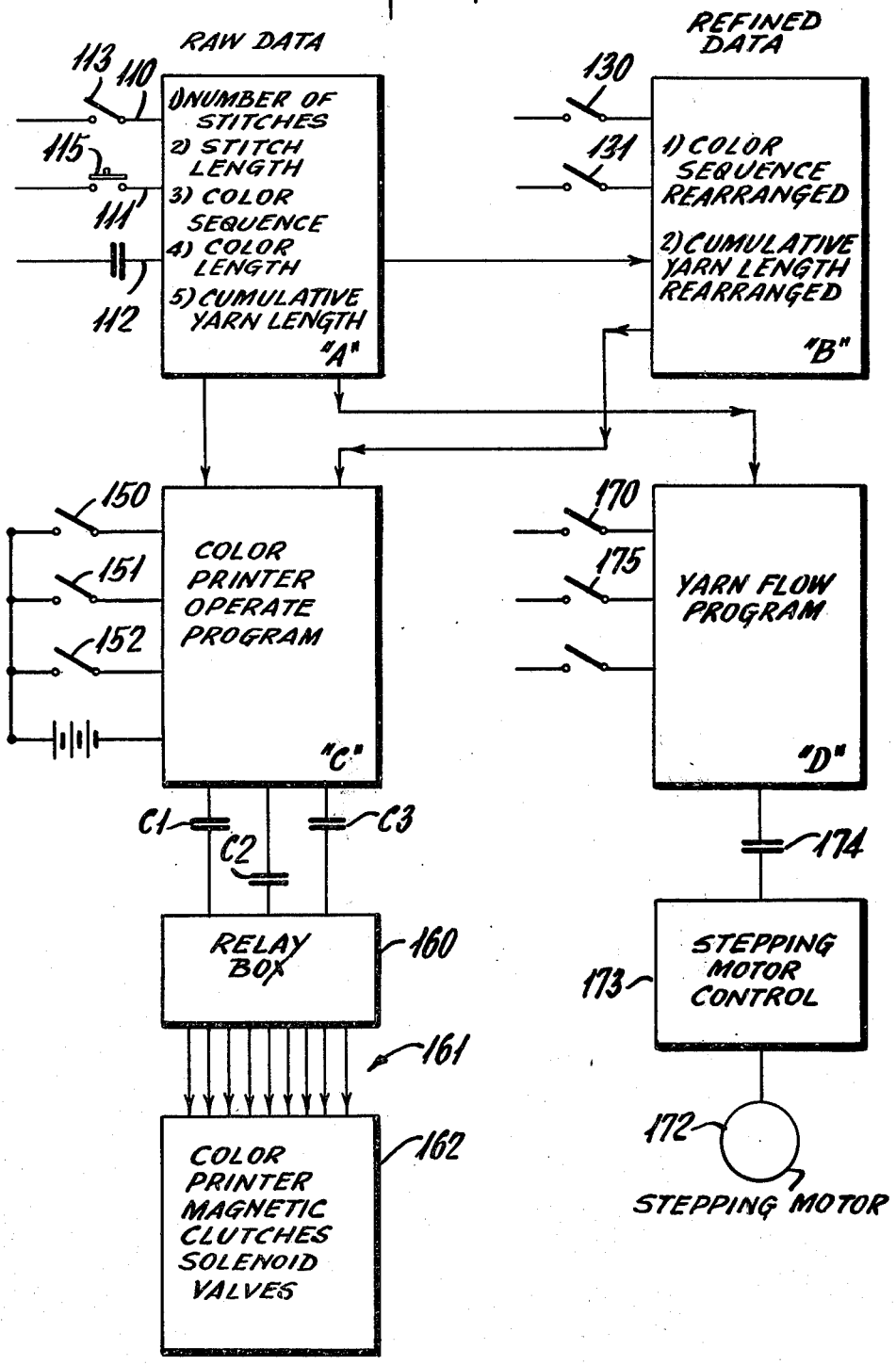
FIG. 16 shows a simplified schematic diagram for computer operation of the printer machine.

The program for printing the yarns is comprised of four parts namely (1) data gathering, (2) data refinement, (3) color printer operation and (4) yarn flow control. The program and design data are stored in the memory of a computer device manufactured by the "Gould Corporation" and called the "Modicon 584 Programmed Controller". FIG. 16 shows, for illustration purposes only, a block diagram showing the memory of the computer divided into four sections "A", "B", "C", and "D". Although the entire program is considered as one written program, it can be operated in four parts. The basic program and data at any stage may be recorded on magnetic tape.

Figure 14:
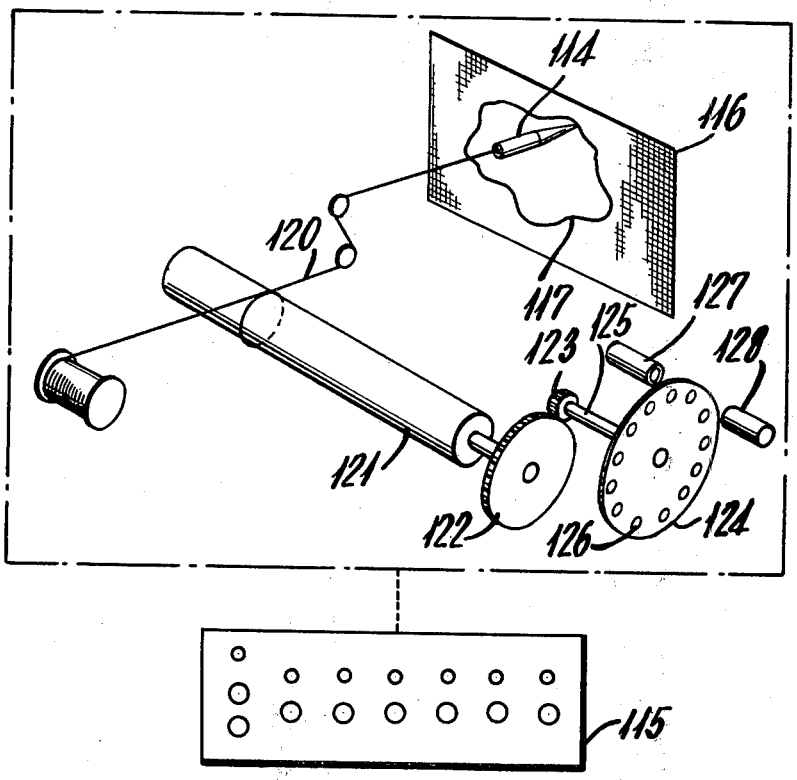
FIG. 14 shows a simplified diagramatic view of stitching data gathering for use in a computer.

Referring to FIG. 16, section "A" of the computer memory, the said memory receives raw data from three input sources, 110, 111 and 112 each of which represents (1) stitch count as initiated by the needle switch 113 which initially comes from a needle bar 114, of the design punch machine shown and illustrated in FIG. 14. The color selection is determined by pushing one of seven pushbuttons from a panel 115 operated by the design punch machine operator, again as shown in FIG. 14.

Before proceeding further with the data applied to the memory bank of the "Modicon Computer 584", as illustrated in FIG. 16, the raw data info is generated by the system as shown in FIG. 14. In particular FIG. 14 shows a fabric piece 116 having a particular pattern or design 117 made up of different colored yarns or fibers. By suitable pantograph means the design pattern is traced out by a needle bar 114 on a stitch-by-stitch basis. Each time a stitch is made, the needle switch 113 shown in FIG. 16 is closed so that a pulse-like signal is fed into the memory bank "A". The number of stitches for a particular yarn length is determined by the arrangement shown in FIG. 14. The needle bar 114 has attached thereto yarn fiber 120 wrapped around a felt roller 121 carrying at one extremity thereof a gear wheel 122 in mesh with gear wheel 123 at a 5 to 1 reduction. The gear wheel 123 is shaft connected to a perforated disc wheel 124 by shaft 125, the perforation 126 being peripherally spaced a distance representative of a particular yarn length in millimeters, preferably, but not necessarily one (1) mil. Each stitch, or indexing the wheel one perforation, permits an interruption of a light beam source 127 directed to a photo-cell 128.

Thus what has been acquired from the foregoing are five sets of data stored in the memory bank of the "Modicon 584" programmed controller. All data are stored as members in registers of the 584 controller, namely (1) number of stitches, (2) length of each stitch, (3) color sequence as dictated by the particular design or pattern, (4) color length of each length of yarn as it appears in the pattern, and (5) total yarn length corrected for color box position in the color printing machine. Section "A" of the 584 memory has all this data stored therein and the data can be used immediately, or recorded on magnetic tape for future use.

The total yarn length for each color change represents a set of data or cumulative yarn lengths at the point of each color change. These lengths have been corrected for color stations in the printing machine, thus resulting in a table of numbers which are not in numerical order. The operating program for the printer will use these lengths to index the start of the next color, therefore they must be arranged in numerical order. This is arranged in Section "B" of the 584 memory, shown in FIG. 16. A sort program is included in the total program to rearrange the cumulative lengths in numerical order. The same sort program will rearrange the color sequence to agree with the rearranged cumulative lengths. This is accomplished automatically by the 584 computer after the sort start switch 130 is activated. A reset switch 131 is provided after the sort is complete so that the program can sort a second set of data. Also by altering the sort program a second design can be made from the original raw data. After the raw data has been sorted it is stored in the memory of the 584 computer, and is ready to operate the color printing machine.

Three sets of data are used in the program to operate the color printer machine, (1) rearranged cumulative lengths, (2) rearranged color sequence, and (3) color lengths, and these are forwarded to Section "C" of the 584 memory as shown in FIG. 16. The program also provides manual switches 150, 151 and 152 for start, pause and reset. When the start switch 150 is activated, the 584 computer will start the feed rollers 90 of the color printer 2 shown in FIG. 5, and at the same time it will take the first number from the length table in the computer memory shown in FIG. 16. It will then time out until the elapsed time in 0.01 seconds equals the above first number. It will then take the second length manner and at the same time select the first color from the memory bank. This will actuate one of the selected color rollers of station 13 shown in FIG. 5 which will operate to print the desired lengths of color which was stored in the raw data memory.

The program will then time out to the second length number and then select the third length number and the second color. This process will continue until all length numbers and color sequence numbers have been used. The program process will stop and sound an alarm. Due to the design of the color printing machine 2, when the color stations 13 are spaced 10.5 inches (267 mm.) apart, it is possible when printing short lengths of color for two stations to be printed simultaneously, or waiting for a lower level station to print when it is next in sequence. This feature is provided for in the program.

If it is necessary to interrupt the operation, the pause switch 151 is turned on. To continue operation, the pause switch is turned off. To repeat the sequence, the start switch 150 is turned off, the reset switch 152 is turned on and then off. After this the start switch 150 is again turned on.

The speed of the color printer is designed so that one unit of yarn length flows through the machine each 0.01 seconds. The Modicon 584 computer communicates to the color printer through a relay box 160 with eight conductors 160 passing from the relay box to the color printer 162 as shown in FIG. 16, each of the separate conductors 161 representing a separate control for each of the color stations 13, and a common ground. The computer through computer contacts C1, C2, C3 and etc. operates suitable relays in relay box 160 which is shown schematically by FIG. 17 to be further described. The controls from the relay box 160 actuates the selected magnetic clutches 31 indicated in FIG. 7, and air valves 40, 41. The color printer operate program ("C") is part of the overall program stored in the memory of the 584 computer.

Figure 18:
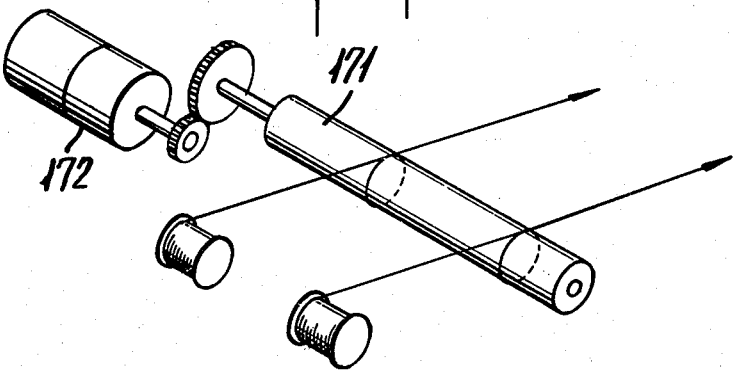
FIG. 18 shows a system for feeding the programmed (printed yarn) to the loom for the fabrication of the finished pattern.

Referring now again to FIG. 16, the yarn flow program Section "D" of the 584 computer receives its input from Section "A" where raw data has been stored. This part of the program, yarn flow program, is independent of the printer control program, but is part of the overall program. This part of the program uses the number of stitches and stitch length data in the raw data part Section "A" as above stated. The program is commenced by turning the start switch 170 connected to Section "D". The purpose of the yarn flow program is to control the flow of the printed yarn into the embroidery machine. It does this by controlling the rotation of the felt roller 171 of the embroidery machine through a stepping motor 172 as shown in FIG. 18. The printed yarn when used by the loom or embroidery machine, whatever, the stitching process must be synchronized with the computer memory program which controlled the printing process.

Again referring to FIG. 16, Section "D", the yarn flow program, after the start switch 170 is turned on a micro switch attached to the needle bar, not shown, of the embroidery machine will select the first stitch from the 584 memory. The program will then index the stepping motor 172 of FIG. 18, the number of units of yarn length specified by the first stitch length. In the second stroke of the needle bar, the micro switch will select the second stitch length and the operation will repeat until all stitches have been used from the computer memory. The computer communicates with the stepping motor through a stepping motor control 173. The stepping motor indexes one step each time the relay computer contact 174 closes. After all the stitches have been withdrawn from the memory, Section "D", the process can be stopped by turning the start switch 170 off, or can be repeated by turning the reset switch 175 on and then off.

Figure 17:
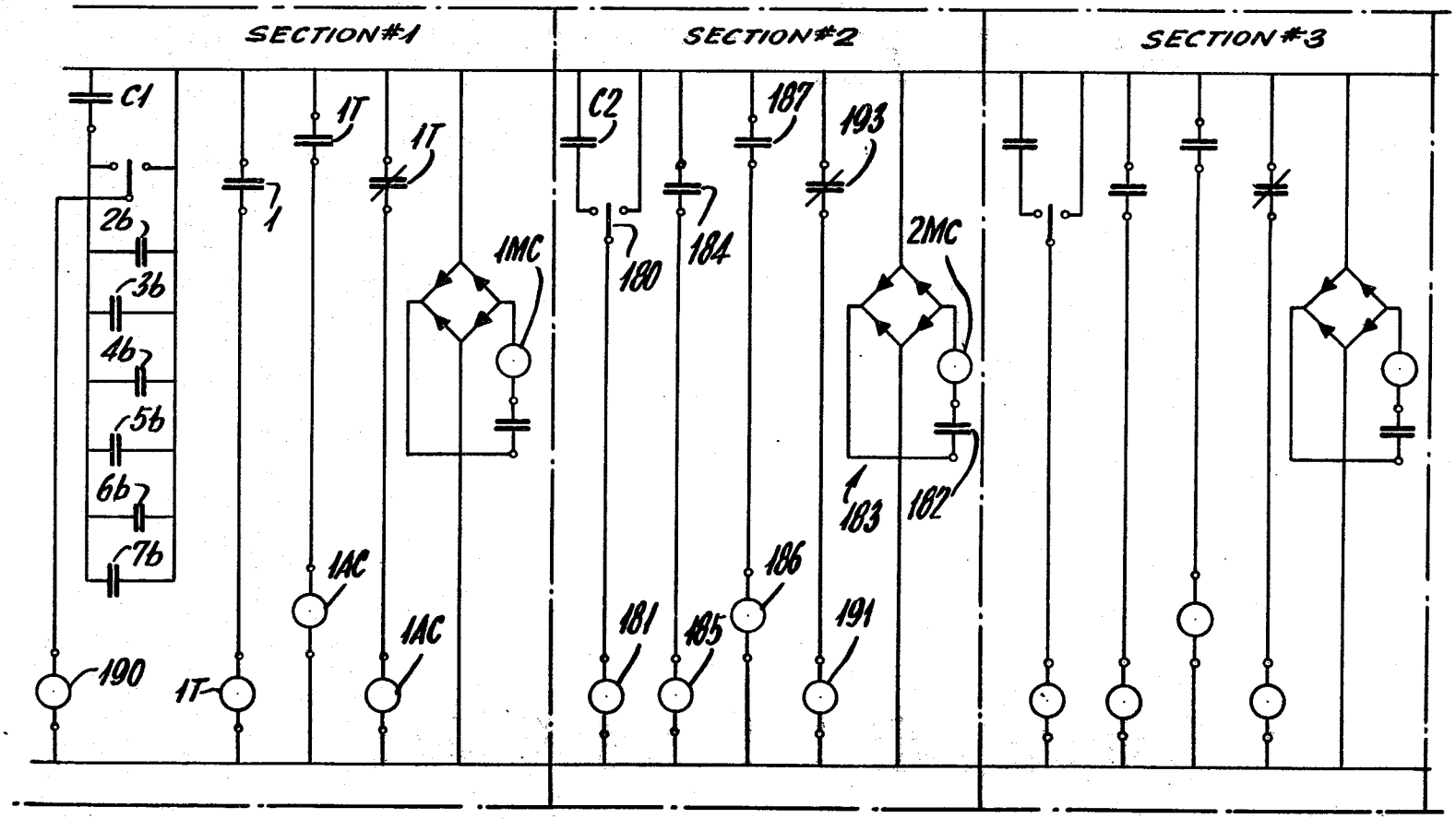
FIG. 17 shows a wiring diagram for the controller responsible to computer instructions for controlling the operation of the printing machine.

The control relay box 160 shown in FIG. 16 is in part schematically illustrated by FIG. 17 and is shown how it receives commands from the computer so as to control the printer movements and the magnetic clutch arrangements associated therewith. In the diagram of FIG. 17, the circuits are repeated for each section so that it would suffice to explain one. Each of the control sections is tied into and identifiable with each of the color stations 13 of FIG. 2, but also the stations 90 and 91 having to do with moving the yarn at a uniform speed and the control thereof. Assume computer relay C2 closes and through auto-manual switch 180 it will pick up relay 181. Contact 182 of relay 181 will close the D.C. circuit 183 of magnetic clutch 2MC which starts the printing rollers turning. A second contact 184 of relay 181 energizes coil 185 which times out for 2.6 seconds, after which time the down side of magnetic clutch coil 186 is activated through a normally open (NO) contact 187. This closes the rollers together to start printing. A third normally open contact of relay 181, will pick up relay 191 of that section, which then simultaneously operates the first station 90 of printer 2 as shown in FIG. 2, when any of the other printers 13 of said figure are operating. When the computer contact C2 of section 2 in FIG. 17 opens, relay 181 drops out and this in turn drops out timing relay coil 185 which opens printing rollers of second station 13 by activating the up-side switch 191 of the solenoid valve coil through a normally closed contact 193 of timing relay coil 185. When relay 181 drops out this also stops the magnetic clutch. Normally open contacts of 26, 36, 46, 56, 66, and 76 shown in section 1 of FIG. 17, are paralled so as to activate the circuits of printing station 90 of FIG. 2 when any of the color printing stations are operative.

Switch 180 in Section 2 of FIG. 17 to manual operation will permit bypass of the computer contact C2 and the operation as above defined will be duplicated.

Relay 190 is comparable to the relay 181 of section 2 and activates color section 1 as described with respect to section 2.

The terms and expressions which have been expressed are used as terms of description and not of limitation, and there is no intention in the use of such terms and expressions of excluding any equivalents of the features shown and described or portions thereof, but it is recommended that various modifications are possible within the scope of the invention claimed.

Having defined the invention what is claimed is:

1. In a system for controlling the printing and processing of colored yarn fibers, held together by soluble cross-fibers, by mechanized means in response to programmed signals derived from computerized control means indicative of a pre-conceived or pre-select pattern or design, the color printed yarns being disposed to feed directly into a loom to produce the said pattern or design or into storage means for future use, the said system comprising:

data acquisition means including a sample pattern to be duplicated, needle stitching means for tracing out said yarn pattern to produce a finite number of signals indicative of said stitches encompassing the whole of said pattern, and comparable signals indicative of the length of said stitches, the said signals indicative of stitch numbers and stitch lengths being transmitted and stored in the computer control means for subsequent retrival and control of the mechanized means, color selection means for producing signals indicative of colors and lengths thereof of the sample pattern during the needle stitch tracing out process, the said signals being transmitted to and stored in the computer control means to be used in conjunction with the said stitch numbers and stitch length for control of the mechanized means, computer means for receiving said data comprising (1) stitch numbers (2) stitch length, (3) color selection and (4) length of color selection for each stitch length, the said data being stored in computer register means which process the raw data into refined data; the combined raw and refined data producing command signals indicative of the original patterns, control means for receiving said command signals to produce output control signals indicative of said commands, color printing mechanized means for receiving said output control signals, the said mechanized means comprising a plurality of vertically stacked spaced apart color stations each supported by a frame having vertically spaced apart supports, the said stations each bridged across and carried by said supports, each station comprising a pair of suspendable shaft supported abutting rotatable rollers pivotally connected to fixed support shafts by linkage means, the said fixed support shafts each attached to vertically spaced apart support brackets carried by a base plate attached to the vertical frame supports, spur gears connected to an extremity of said rollers for the rotation thereof in response to driver gear means connected thereto and supported by rotatable drive shaft means, the said vertical shaft being supported by the said frame and rotatably driven by a power source attached to an extremity thereof, a pair of reciprocal hydraulic means, disposed to receive control signals from said computer programmed controllers in proximity to the said roller extremities and supported by said spaced apart bracket and each having depending pneumatic arms each pivotally connected to linkage arms whose extremities functionally engage the said linkage means connected to the suspended rollers, the said pneumatic means being reciprocally responsive to the programmed control signals for functionally causing the rollers to engage and disengage each other contact wise during the course of color printing and non-printing in accordance with the selected pattern design, printed yarn processing means for receiving from said color printer mechanized means, the said printed yarn processing means comprising carrier support means for receiving and transporting the printed yarns leaving said color printer mechanized means, first heat control means for receiving the said carrier support yarns and applying heat thereto for the color fixation thereof, yarn separation means including bath enclosures for removing excess dyes, dissolving cross-fibers holding yarns in place and final wash of the separated yarns, second heat control means for receiving the supported separated yarns and drying same, and yarn receiving means for receiving the separated dried yarns from the second heat control means for storing the yarns or directing the yarns into the looms for immediate use to produce the desired design and or pattern.

2. In a system for color printing and processing multiple yarn fibers by mechanized means in response to signals derived from computerized control means indicative of fabrics having select color patterns or designs the system comprising:

(1) needle stitching means including a sample pattern for producing new data in the form of electrical impulses responsive to the tracing of said pattern by the said needle stitching means indicative of the pattern and color thereof, (2) computer means for receiving said new data electrical impulses derived from said needle stitcing means and referring the raw data electrical impulses with command signals indicative of the pattern to be duplicated, (3) power control means including reciprocal controllable pneumatic means responsive to the command signals from the said computer for developing fluid streams disposed to produce driving forces in a direction to produce the patterns to be duplicated by the mechanical means, (4) mechanized apparatus including dual abutting printing roller means disposed to receive said pneumatic fluid forces to activate said roller means to uniformly color print circumferentially the multiple yarn fibers, and color saturate same in accordance with the pattern to be duplicated as the yarns pass through the dual abutting roller means, (5) multiple yarns processing means for receiving said yarns to fix the colors printed thereon and to separate the multiple yarn fibers into individual strands, and (6) means for receiving and playing back the said printed yarns directly into a loom type apparatus for producing fabrics duplicating the original pattern or in the alternative storing said yarns for later usage in said loom apparatus.

3. A system according to claim 2 and wherein said needle stitching means includes stitching apparatus for tracing out said sample pattern to produce a finite number of electrical impulse signals indicative of said stitches eneompassing the whole of said pattern and comparative impulse signals indicative of the length of said stitches, the said impulse signals being transmitted and stored in the computer control means for subsequent retrieval and control of the mechanized apparatus.

4. A system according to claim 3 and wherein said needle stitching means further includes color selection means for producing signals indicative of color and lengths of the sample pattern during the needle stitch tracing out process, the said signals being transmitted to and stored in the computer control means to be used in conjunction with the said stitch numbers and stitch length for control of the mechanized means.

5. A system according to claim 2 and wherein said computer means includes register means for receiving the said raw data electrical impulses in the form of stitch numbers, stitch lengths, color selection, and length of color selection for each stitch length, the said data being stored in said registers for processing to produce command signals indicative of the original pattern or design.

6. A system according to claim 5 and wherein said register means includes registers for processing raw data into refined data and the combined data producing the said command signals.

7. A system according to claim 2 and wherein said power control means includes circuit means for receiving the command signals and producing control voltages selectively indicative of the program data for selective operation of the mechanized apparatus for color printing of the yarn fibers according to the original patten or design.

8. A system according to claim 2 and wherein said mechanized apparatus includes a plurality of color printing stations including dual abutting continuously oppositely rotating rollers at each station and each disposed to receive said control signals and each have color dye means in proximity thereto to permit the rollers to uniformly and circumferentially color print the yarns in response to said control voltages, as the yarns move from station to station through and between the abutting rollers.

* * * * *